US006400918B1

(12) United States Patent
Ishii et al.

(10) Patent No.: US 6,400,918 B1
(45) **Date of Patent: *Jun. 4, 2002**

(54) CLEANING DEVICE AND IMAGE FORMING APPARATUS USING THE CLEANING DEVICE

(75) Inventors: Yasuyuki Ishii; Norihisa Hoshika; Takashi Hibi, all of Mishima; Takeo Shoji, Shizuoka-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/780,774

(22) Filed: Jan. 9, 1997

(30) Foreign Application Priority Data

Jan. 12, 1996 (JP) ..... 8-020649

(51) Int. Cl.[7] ..... G03G 15/30
(52) U.S. Cl. ..... 399/149; 399/354
(58) Field of Search ..... 399/149, 150, 399/354, 343, 71

(56) References Cited

U.S. PATENT DOCUMENTS 5,162,858 A 11/1992 Shoji et al.
5,204,034 A 4/1993 Sesame et al. ..... 264/138
5,438,397 A * 8/1995 Okano et al. ..... 399/150
5,497,224 A * 3/1996 Ishikawa et al. ..... 399/354
5,563,691 A * 10/1996 Hayakawa et al. ..... 399/149
5,610,697 A * 3/1997 Arai ..... 399/149

FOREIGN PATENT DOCUMENTS

JP 57-100460 * 6/1982

* cited by examiner

*Primary Examiner*—Robert Beatty
(74) *Attorney, Agent, or Firm*—Fitzpatrick, Cella, Harper & Scinto

(57) ABSTRACT

A cleaning device for removing toner remaining on an image carrier carrying a toner image after toner on the image carrier has been transferred to another material, the cleaning device including: a conductive brush roller to which a bias voltage of a polarity that is the same as the proper polarity of toner for use in development is applied in order to remove that portion of the toner remaining on the image carrier after the image transfer process whose polarity has become opposite to the proper polarity of toner for use in development; a roller electrode which comes into contact with the bush roller and to which a bias that is of a polarity opposite to that of the brush roller is applied to electrostatically attract the toner adhering to the conductive brush; and scraping device for scraping off the toner adhering to this roller electrode, wherein that portion of the toner remaining on the image carrier after the image transfer process whose polarity has become opposite to the proper polarity of toner is removed by the brush roller and that portion of the toner which maintains the proper polarity is allowed to pass.

25 Claims, 10 Drawing Sheets

CLEANING DEVICE AND IMAGE FORMING APPARATUS USING THE CLEANING DEVICE

BACKGROUND OF THE INVENTION

1. Field of the Invention

The present invention relates to a cleaning device for removing toner remaining on an image carrier after transferring a toner image formed on the image carrier by applying electrophotography, and to an image forming apparatus, such as a printer, a copying apparatus or a facsimile apparatus, to which this cleaning device is applied.

2. Description of the Related Art

Conventionally, in an image forming apparatus such as an electrophotographic copying machine or a printer, an image is generally formed by the following series of processes: a charging process for uniformly charging, for example, an electrophotographic photosensitive drum; a latent image forming process for forming an electrostatic latent image on the photosensitive drum; a developing process for developing the electrostatic latent image by using toner; a transferring process for transferring the toner image obtained by the developing process to a transfer material; a fixing process for fixing the transferred toner image to the transfer material; and a cleaning process for clearing away the remaining toner, etc. adhering to the photosensitive drum after the transfer in order to make the apparatus ready for the next image forming process. The toner remaining after the transfer, generated in the photosensitive drum cleaning process, has conventionally been all recovered in a toner container in the cleaner.

As a result of the recent demand in the market for a reduction in the running cost of image forming apparatuses, contrivances for increasing the service life of the parts of the apparatus have been examined and put into practical use. An example thereof is a so-called toner supply type image forming apparatus, in which a consumed portion of toner is repeatedly supplied to the developing device, thereby making it possible for the developing device to be used for a long period of time. FIG. 10 shows an example of this conventional toner supply type image forming apparatus.

As shown in FIG. 10, the image forming apparatus has a rotary drum type electrophotographic photosensitive member, i.e., a photosensitive drum 1. The photosensitive drum 1 is rotated clockwise (in the direction of an arrow A), and a bias is applied to a charging roller 2 by a power source 2*a*, whereby the photosensitive drum 1 is uniformly charged. A laser beam 3 from an exposure means is applied to this photosensitive drum 1, whereby image information is formed on the surface of the photosensitive drum 1 as an electrostatic latent image.

As the photosensitive drum 1 rotates, the latent image reaches a developing section opposed to a developing device 4, and is developed by using toner carried by a developing sleeve 4*b* of the developing device 4. During the development, a bias is applied to the developing sleeve 4*b* by a power source 4*a*. In order that the toner layer on the developing sleeve 4*b* for use in development may have a fixed uniform thickness, the developing sleeve 4*b* is in elastic contact with a doctor blade 6. This blade 6 is formed of urethane rubber or the like, and its base section is mounted to a container 4*c* of the developing device 4. When toner 5 in the developing container 4*c* has been consumed as a result of development and become less than a predetermined amount, the user opens a supply inlet 7 in the upper section of the container 4*c* to supply new toner.

As the photosensitive drum 1 rotates, the toner image formed on the photosensitive drum 1 by the development of the latent image is conveyed to a transfer section opposed to a transfer roller 8, and transferred to a transfer material 9, which is supplied to the transfer section from a paper feed section (not shown) with a predetermined timing. The transfer material 9 which has passed the transfer section 9 is separated from the photosensitive drum and conveyed to a fuser (not shown), where the fixing of the toner image on this transfer material is effected.

The portion of toner 100 (including other adhering matter such as paper powder) remaining on the photosensitive drum 1 after the transfer process is cleared away by being scraped off the drum by a cleaning blade 110 constituting cleaning means, and is accommodated in a cleaner container 120 as toner 101.

In the above construction, the photosensitive drum 1, the transfer roller 2, the developing device 5, and the cleaning means including the cleaning blade 110, the cleaner container 120, etc. are, as shown in FIG. 10, integrally supported by supporting means and assembled as a process cartridge, and this cartridge can be detachably mounted to the apparatus body.

However, in the above-described toner supply type image forming apparatus, the amount of toner 101 recovered in the cleaner container 120 increases as toner is supplied to the apparatus, with the result that the size of the cleaner container has to be rather large.

In order that the size of the entire apparatus may be reduced, it is desirable that the size of the cleaner container 120 be reduced. For that purpose, it is necessary to frequently perform maintenance operations such as the replacement of the cleaner container to dispose of the recovered toner. There is a method for achieving, apart from the reduction in the size of the cleaner container 120, an improvement in the efficiency in the use of toner, according to which the recovered toner is mechanically fed to the developer container 4*c*, which, however, involves a complicated structure.

SUMMARY OF THE INVENTION

It is an object of the present invention to solve the above problem in the prior art. The present invention aims to reduce the amount of toner recovered by the cleaning means.

Another object of the present invention is to make the capacity of the toner container of the cleaning means as small as possible.

Still another object of the present invention is to make the capacity of the toner container of the cleaning means as small as possible and to reduce the volume of the process cartridge including this cleaning means.

A further object of the present invention is to provide an image forming apparatus having such cleaning means.

To achieve the above objects, the present invention provides a cleaning device for removing a remaining portion of toner remaining on an image carrier after toner on the image carrier which carries a toner image has been transferred to another material, the cleaning device comprising: a conductive brush roller to which a bias voltage of a polarity that is the same as the proper polarity of toner is applied in order to remove that portion of the residual toner on the image carrier after the image transfer process whose polarity has become opposite to the proper polarity of toner used for development; a roller electrode which comes into contact with the brush roller and to which a bias that is of a polarity opposite to that of the brush roller to electrostatically attract the toner adhering to the conductive brush; and scraping means for scraping off the toner adhering to this roller electrode, wherein that portion of the residual toner existing on the image carrier after the image transfer process whose polarity has become opposite to the proper polarity of toner is removed by the brush roller and that portion of the residual toner which maintains the proper polarity is allowed to pass.

Further, the present invention, which achieves the above objects, provides an image forming apparatus to which the above-described cleaning device is applied.

DESCRIPTION OF THE PREFERRED EMBODIMENTS

First Embodiment

Figure 1:
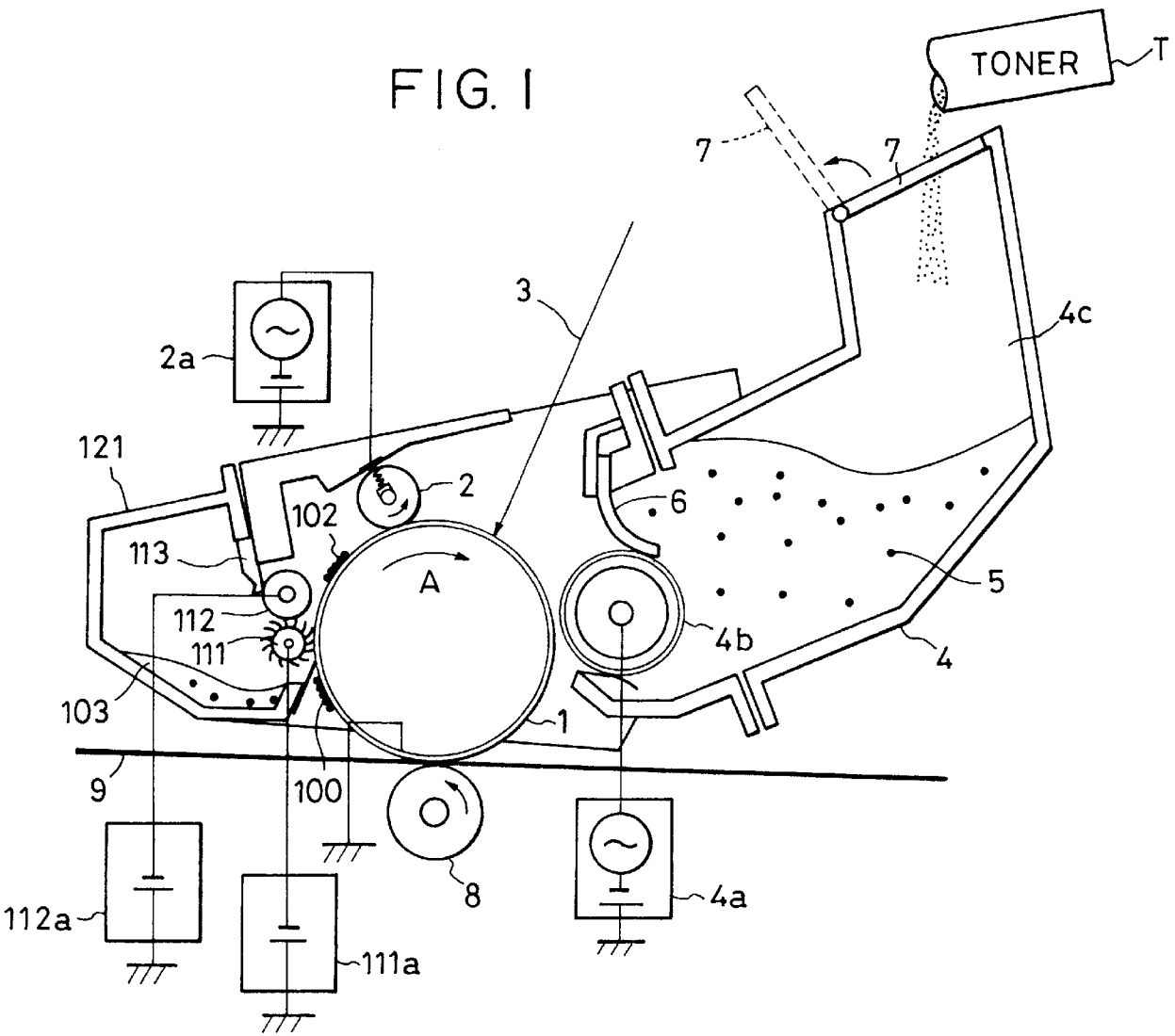
FIG. 1 is a sectional view showing a process cartridge of an image forming apparatus according to an embodiment of the present invention.

FIG. 1 is a sectional view of the essential part of the image forming section of an image forming apparatus according to an embodiment of the present invention.

The image forming apparatus has a rotary drum type electrophotographic photosensitive member serving as an image carrier, i.e., a photosensitive drum 1. The photosensitive drum 1 is rotated clockwise (in the direction of an arrow A), and a bias is applied to a charging roller 2 by a power source 2*a*, whereby the photosensitive drum 1 is uniformly charged. The charging of the photosensitive drum 1 is effected by bringing the charging roller 2 into contact with or close to the photosensitive drum 1 and applying a voltage obtained by superimposing a DC voltage of −720 V to an oscillation voltage the Vpp of which is 2 kV. The charging potential (the dark portion potential) is −700 V. A laser beam 3 from an exposure means is applied to this photosensitive drum 1, whereby an electrostatic latent image whose bright portion potential is −150 V is formed on the surface of the photosensitive drum 1.

As the photosensitive drum 1 rotates, the latent image is conveyed to a developing section opposed to a developing device 4, and then developed by toner carried by a developing sleeve 4*b* of the developing device 4. At this time, a bias of −500 V is applied to the developing sleeve 4*b* by the power source 4*a*. In order that the toner layer on the developing sleeve 4*b* used for development may have a predetermined uniform thickness of 2 mg/cm$^2$ and a charge amount of −7 $\mu$C/g, the developing sleeve 4*b* is in elastic contact with a doctor blade 6. This blade 6 is formed of urethane rubber or the like, and its base portion is mounted to a container 4*c* of the developing device 4. When, as a result of development, the amount of toner 5 in the developer container 4*c* has become smaller than a predetermined value, the user opens a supply inlet 7 in the upper section of the container and supplies new toner into the developer container 4*c*.

The toner 5 used in this developing device may be either magnetic toner or non-magnetic toner. Further, from the viewpoint of manufacturing method, both composite and pulverized toners can be used.

Next, as the photosensitive drum 1 rotates, the toner image formed on the photosensitive drum 1 by the development of the latent image is conveyed to a transfer section opposed to a transfer roller 8, where it is transferred to a transfer material 9 supplied to the transfer section from a paper feed section (not shown) with a predetermined timing. The transfer material 9, which has passed the transfer section, is separated from the photosensitive drum and conveyed to a fuser (not shown), where the fixing of the toner image on this transfer material is effected. Toner portion 100 remaining on the photosensitive drum 1 is scraped off and cleared away by a conductive fur brush roller 111 described below.

The cleaning device of the present invention comprises a conductive fur brush 111, a conductive recovery roller 112, a rubber blade 113 and a cleaner container 121 accommodating these components. In the following, this cleaning device will be described in detail.

The conductive fur brush roller 111 is arranged in the cleaner container 121, with its one side being in contact with or close to the photosensitive drum 1, and rotates in the forward or counter direction at a circumferential speed different from that of the photosensitive drum 1. This fur brush roller 11 has bristles in the form of filaments of conductive fibers having a thickness of 6 d (denier) and a resistance of $2.4\times10^5$ Ω and planted in a density of 100 k filaments/in.$^2$. The outer diameter of the roller is 12 mm.

Figure 2:
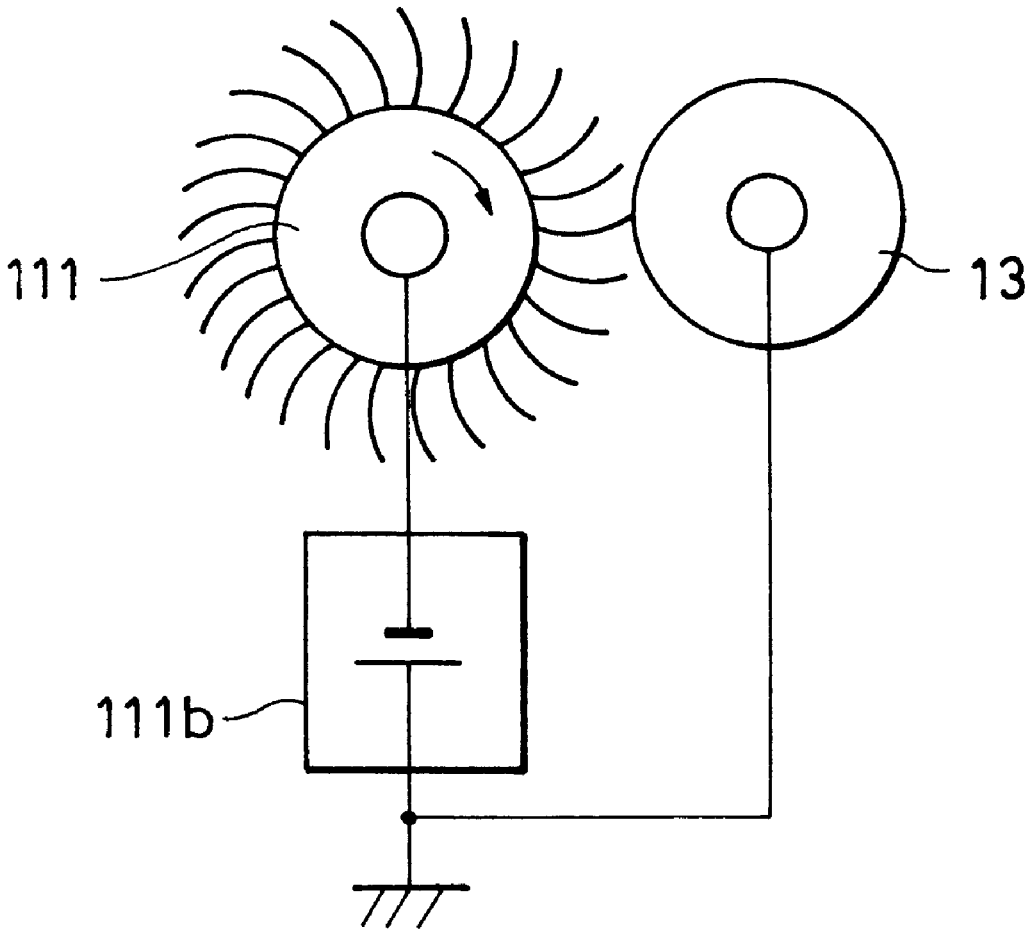
FIG. 2 is a diagram illustrating a method of measuring the resistance value of a conductive fur brush roller provided in the apparatus of FIG. 1.

As shown in FIG. 2, the resistance value of the conductive fur brush roller 111 is measured in a condition in which the fur brush roller 111, being rotated at a speed of 100 rpm, is brought into contact with a metal roller 13 having an outer diameter of 20 mm and rotating at a speed of 90 rpm, with an intrusion amount of 1 mm, and in which a DC voltage of 50 V is applied to the fur brush roller 111 from a power source 111*b*.

The toner 100, remaining on the photosensitive drum 1 after image transfer, is positively charged by the voltage applied to the transfer roller 8. However, part of it is negatively charged, which is the inherent polarity of toner. By applying a negative voltage of −700 V, which is of a polarity opposite to that of the toner portion 100, to the conductive fur brush roller 111 from the power source 111*a*, the portion of the toner 100 remaining after image transfer which is charged to positive polarity by the transfer roller 8 is electrostatically attracted to the fur brush roller 111 to be thereby recovered.

Further, in the cleaner container 121, a conductive recovery roller 112 is provided such that it is in contact with the conductive fur brush roller 111. By applying a voltage of −400 V (−1100 V with respect to the ground) to this recovery roller 112 from a power source 112*a*, the remaining toner 100 of positive polarity, recovered by the fur brush roller 111, is electrostatically attracted to this recovery roller 112 to be thereby recovered. Further, the remaining toner portion 100 recovered by the recovery roller 112 is forcibly scraped off by a rubber blade 113, which is a scraping member in contact with the recovery roller 112, and accommodated in the cleaner 121 as toner 103 to be disposed of.

On the other hand, toner portion 102 (most of which is of negative polarity) which has been allowed to pass the roller 111 without being recovered from the photosensitive drum 1 by the fur brush roller 111, is scattered on the photosensitive drum 1 due to the difference in circumferential speed between the fur brush roller 111 and the photosensitive drum 1. The scattered un-recovered toner 102 has an average grain size of 10 $\mu$m or less and distributed over the photosensitive drum 1 in a density of 0.1 mg/cm$^2$. It has been experimentally ascertained that the spot diameter of the laser beam 3 for realizing 600 dpi ranges from 75 to 90 $\mu$m and that, when the distribution density of the un-recovered toner 102 on the photosensitive drum 1 is 0.1 mg/cm$^2$ or less, there is no deterioration in image quality due to the interception of the laser beam 3 by the un-recovered toner 102.

Due to this fact, no problem is involved if next image formation is conducted with the un-recovered toner 102 being left as it is. In the next image formation, an electrostatic latent image is formed on the photosensitive drum 1 by charging with the charging roller 2 and exposure by the laser beam 3, and the next, new electrostatic latent image is developed by the developing device 4. At this time, the un-recovered toner 102 (which is of negative polarity) exists on the dark potential portion of the photosensitive drum 1. However, it is recovered again by the developing device 4 by the dark potential portion and the developing bias, and re-utilized in development after that.

In the above-described construction, the photosensitive drum 1, the charging roller 2, the developing device 4, and the cleaning means including the conductive fur brush 111, etc. are, as shown in FIG. 1, formed as an integral unit by a support member and assembled as a process cartridge which is detachably mounted to the apparatus body. In accordance with this embodiment, the process cartridge consists of at least a combination of the photosensitive drum 1 and the cleaning means, thereby making it possible to achieve the above object.

As described above, in this embodiment, the photosensitive drum 1 is cleaned by the conductive fur brush roller 111*a*, whereby the toner portion 100 remaining on the photosensitive drum 1 is divided into a toner portion to be recovered and a toner portion 102 to be re-utilized. The toner recovered by the fur brush roller 111*a* is conveyed by way of the conductive recovery roller 112 and accommodated in the cleaner container 121 as the toner portion 103 to be disposed of. The toner portion 102 to be re-utilized is recovered as it is by the developing device 4 and used again for development. Thus, the amount of toner recovered can be made as small as possible, whereby a reduction in the size of the cleaner container 121 is achieved. Further, by forming the cleaner container as a cartridge, there is no need to perform replacement and there is no need to frequently dispose of toner. Thus, in this embodiment, the construction of the image forming apparatus is not complicated. Further, the efficiency in the use of toner can be substantially improved.

Second Embodiment

Figure 3:
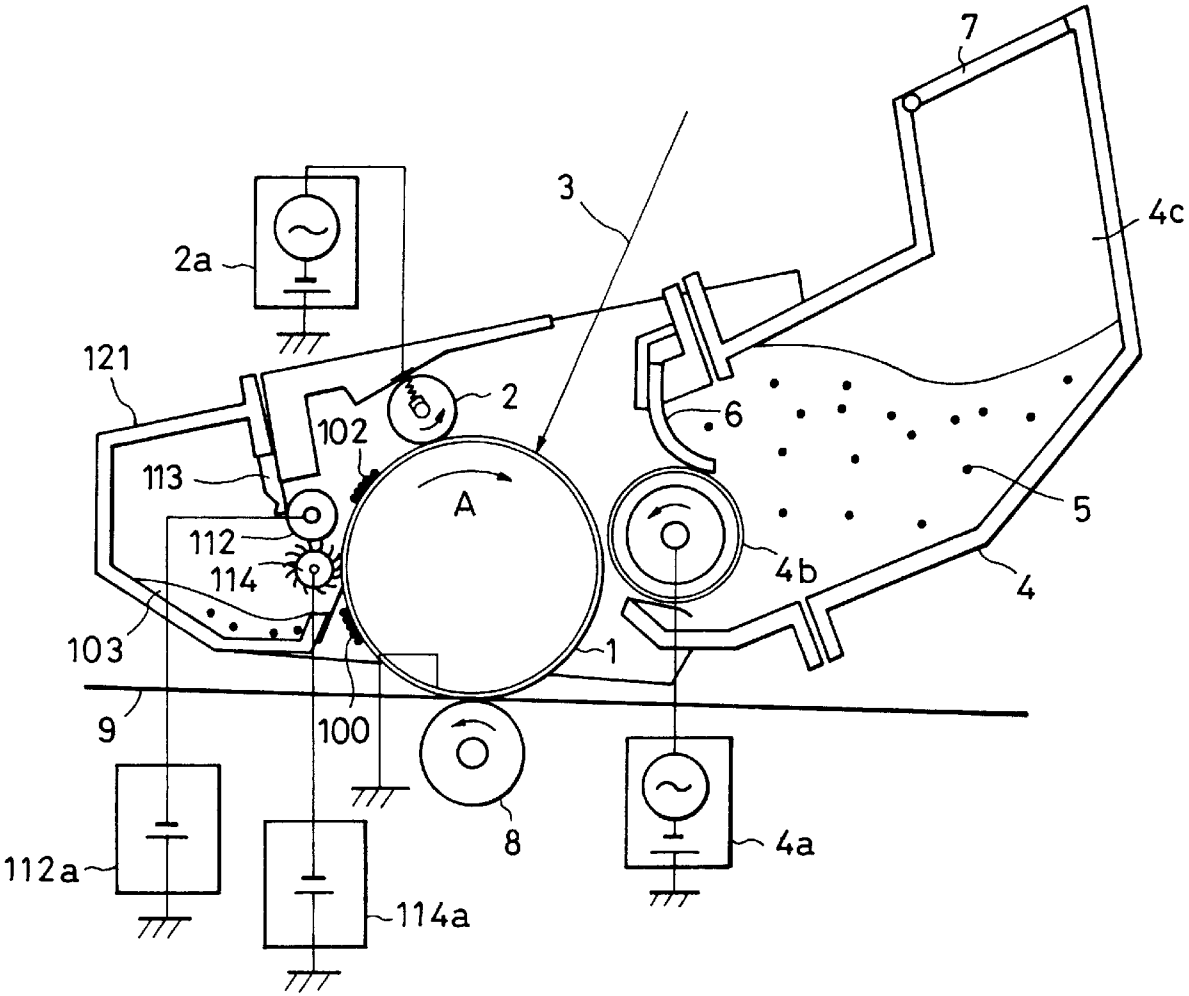
FIG. 3 is a sectional view of a process cartridge according to another embodiment of the present invention.

FIG. 3 is a sectional view showing another embodiment of the present invention. In this embodiment, the bristle density of the conductive fur brush roller 114, the resistance value and the voltage applied by the power source 114*a* are varied, whereby it is possible to adjust the amount of remaining toner recovered and the relative proportion of recovery toner and the toner to be re-utilized can be adjusted. In FIG. 3, the components which are the same as those of FIG. 1 are indicated by the same reference numerals.

Figure 4:
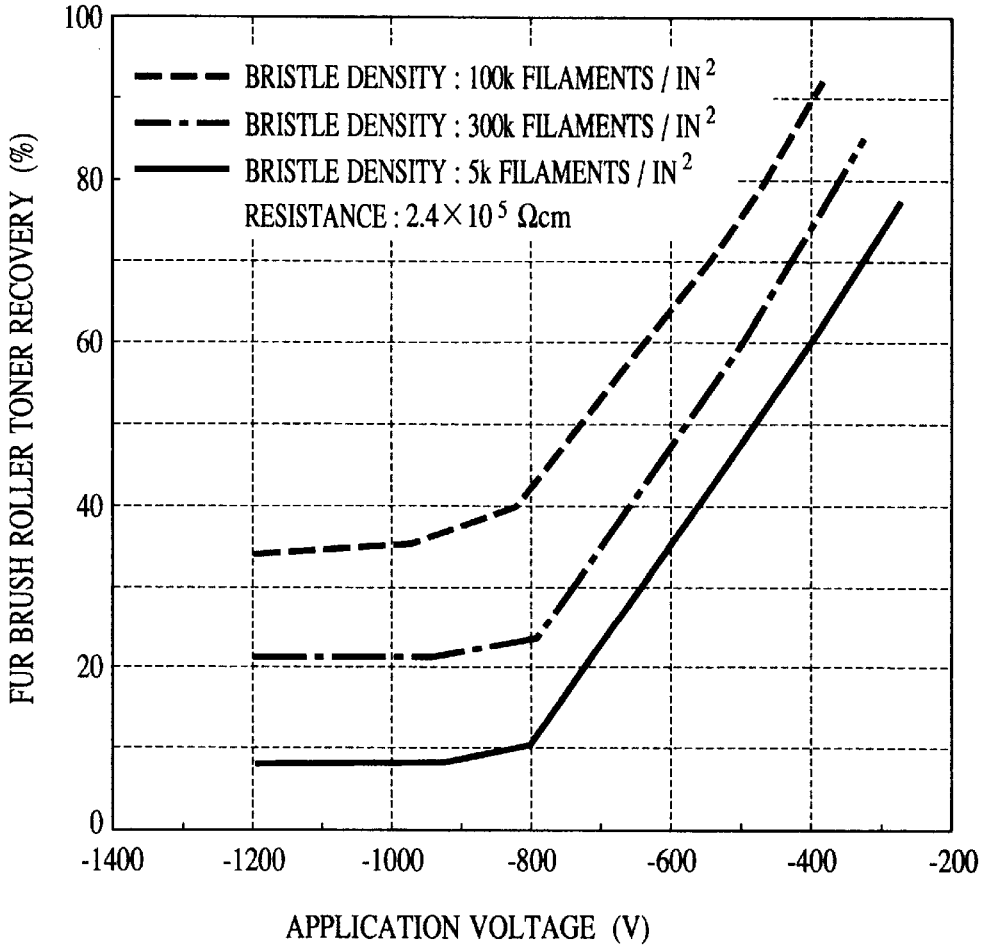
FIG. 4 is a graph showing the relationship between applied voltage and toner recovery at different bristle densities of the conductive fur brush roller provided in the apparatus of FIG. 3.

FIG. 4 shows the relationship between the applied voltage and toner recovery when the bristle density, which is a factor in the above adjustment, is varied. It has been ascertained that, as shown in FIG. 4, by changing the bristle density of the conductive fur brush roller 114 to 50 to 300 k filaments/in.$^2$, it is possible to vary the recovery of the remaining toner by the fur brush roller within the range of 20 to 50% at an applied voltage of −700 V.

Figure 5:
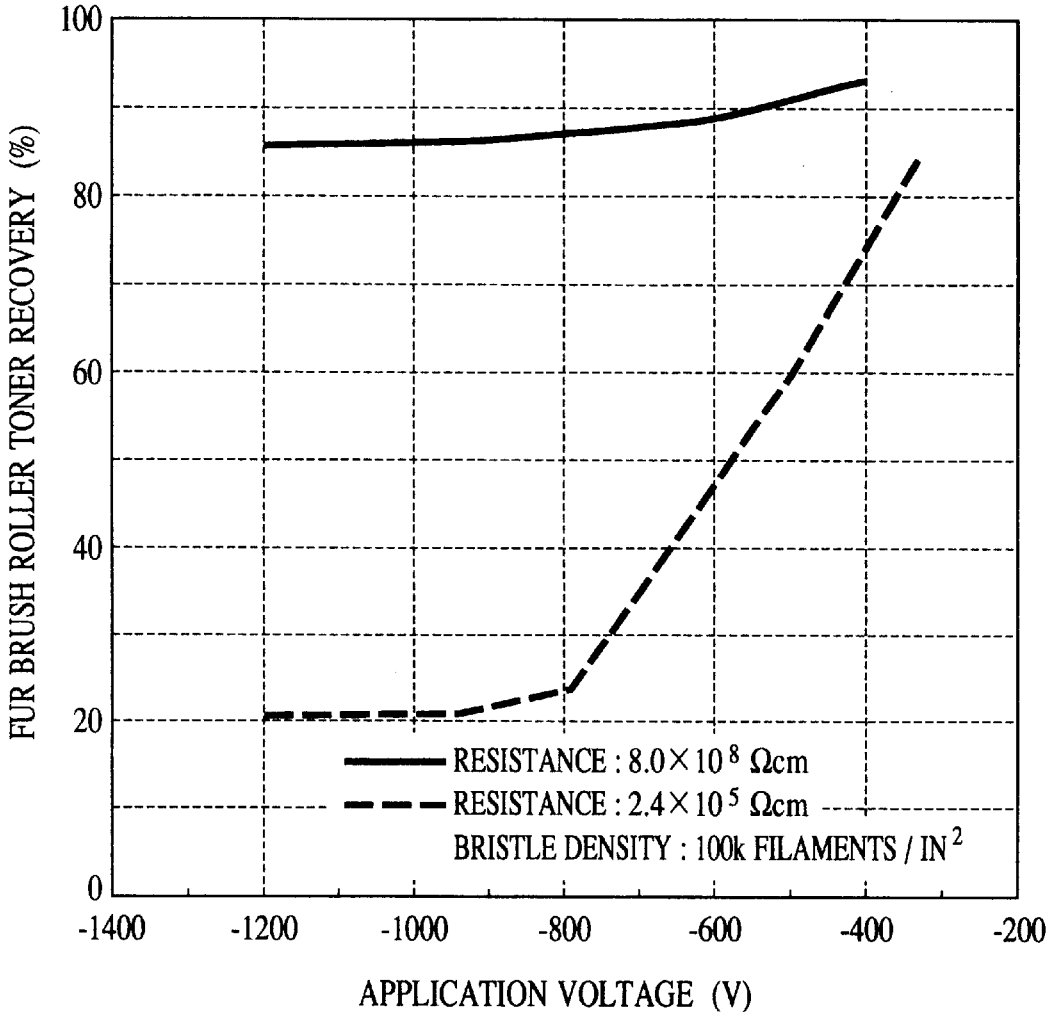
FIG. 5 is a graph showing the relationship between applied voltage and toner recovery at different resistance values of the conductive fur brush roller provided in the apparatus of FIG. 3.

While FIG. 4 shows an example in which the recovery amount is varied by varying the bristle density, FIG. 5 shows the relationship between the applied voltage and the toner recovery when the resistance value of the fur brush is varied. It has been ascertained that, as shown in FIG. 5, by changing the resistance value of the conductive fur brush roller 114 to $2.4\times10^5$~$8.0\times10^8$ Ω, it is possible to vary the remaining toner recovery by the fur brush roller within the range of 30 to 90% at an applied voltage of −700 V. Though not shown in the drawing, it has also been ascertained that, when the resistance value of the fur brush roller is $10^5$ Ω, the toner recovery depends upon the applied voltage.

In this embodiment, the above characteristics are utilized and the bristle density of the conductive fur brush roller 114 and the resistance value are set beforehand in accordance with the formation of the entire apparatus to which the present invention is applied, the image pattern, the possibility of jamming of the transfer material, and the amount of toner remaining after image transfer as a result of changes in the transfer efficiency due to environmental fluctuations, and the relative proportion of the recovery toner and the toner to be re-utilized is controlled. Thus, it is possible to set the amount of toner recovered to an arbitrary value at the time of the production of the apparatus body, etc., so that, in reducing the size of the cleaner container, it is possible to design it such that it has an optimum capacity.

Third Embodiment

Figure 6:
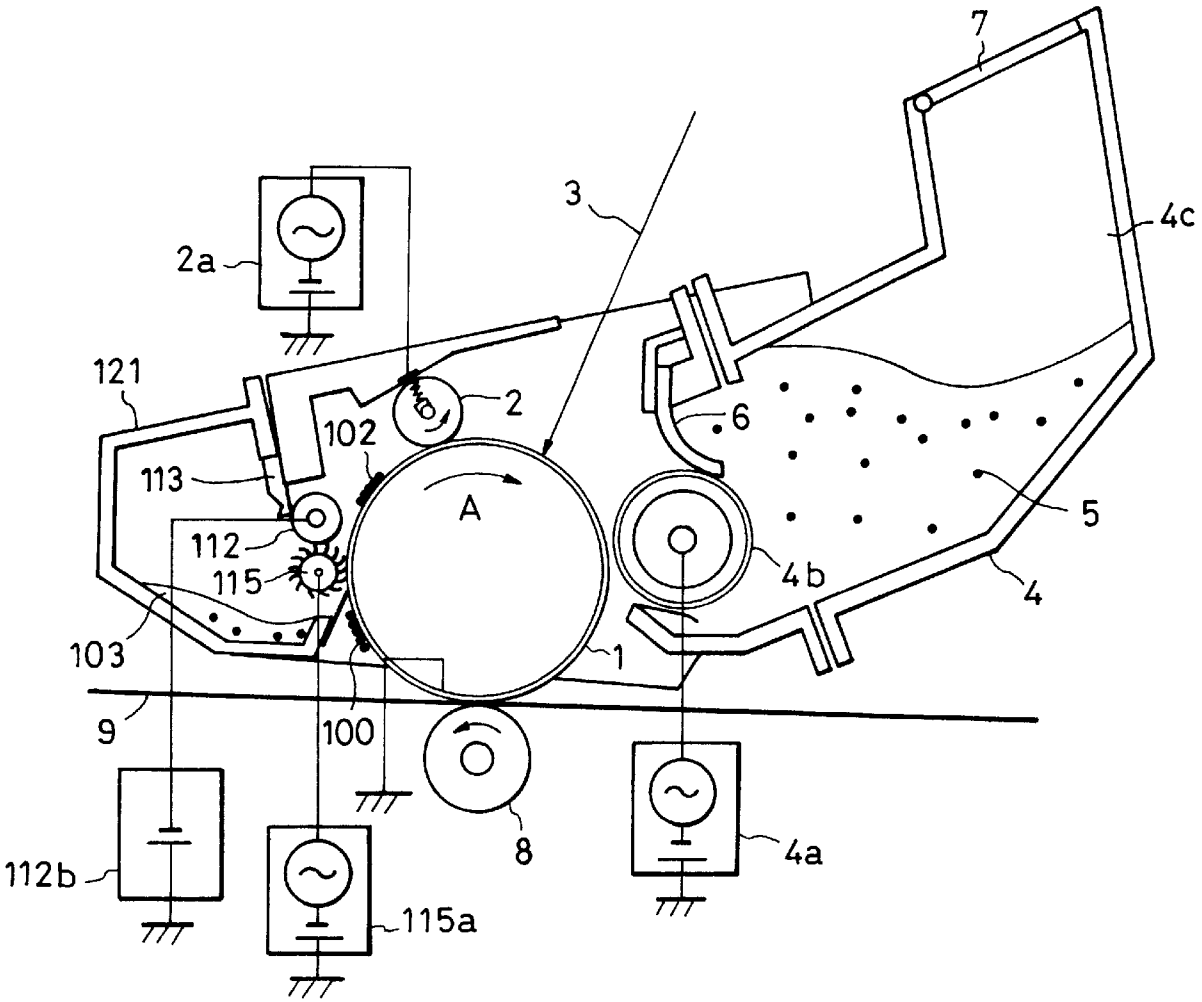
FIG. 6 is a sectional view showing a process cartridge according to still another embodiment of the present invention.

FIG. 6 is a sectional view showing still another embodiment of the present invention. In this embodiment, a voltage obtained by superimposing an oscillation voltage whose waveform is sinusoidal or rectangular on a DC voltage is applied to a conductive fur brush roller 115 by a power source 115, whereby the relative proportion of the recovery toner and the toner to be re-utilized can be controlled.

Figure 7:
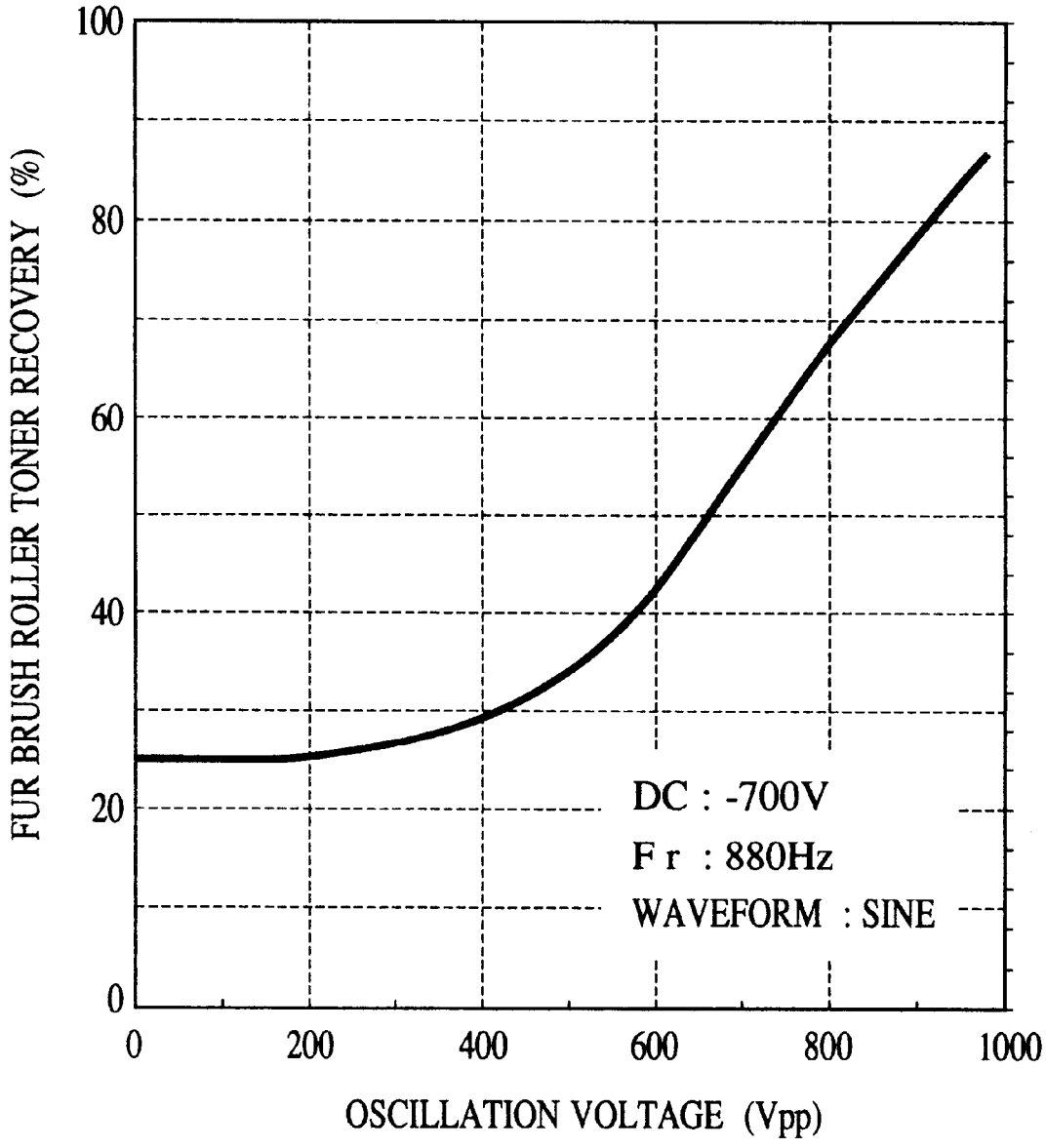
FIG. 7 is a graph showing the relationship between an oscillation voltage as a superimposed voltage applied to the conductive fur brush roller provided in the apparatus of FIG. 3 and toner recovery.
Figure 8:
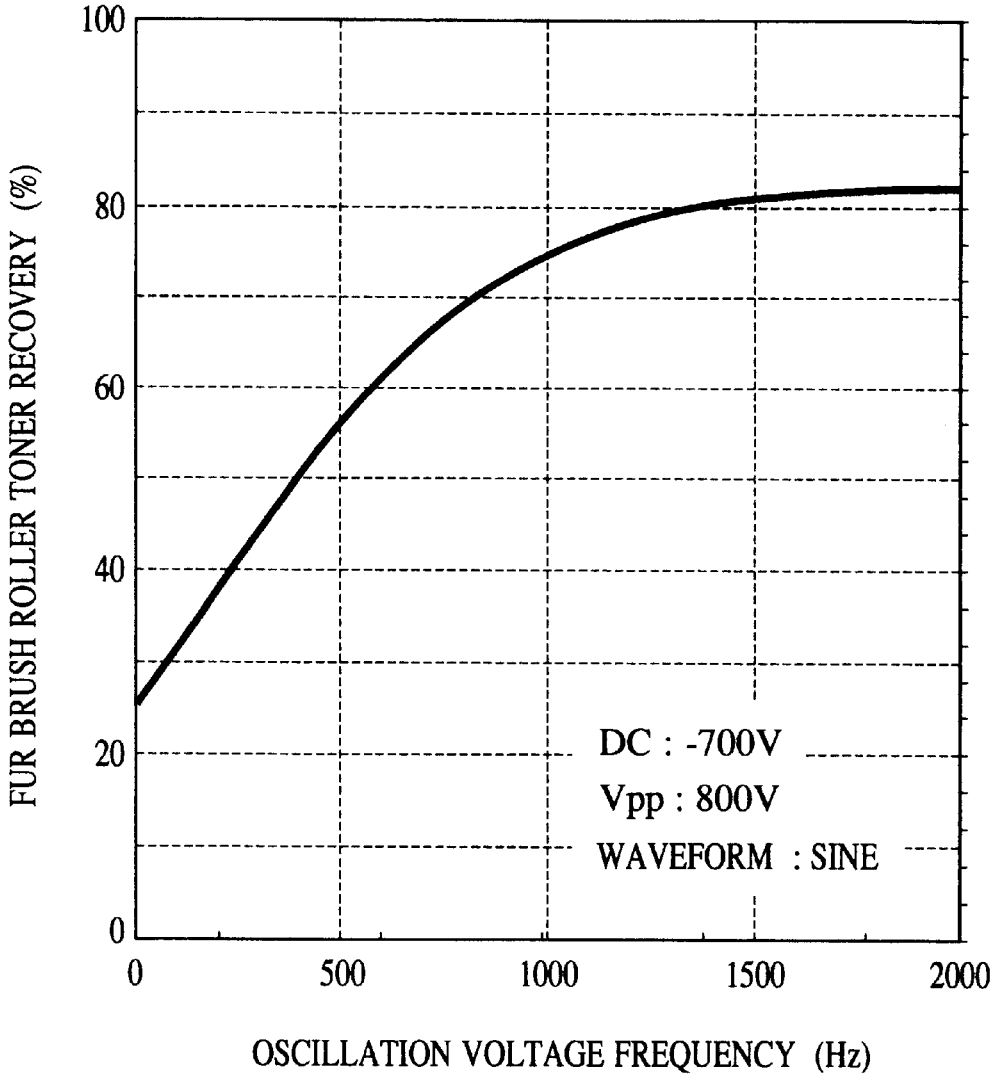
FIG. 8 is a graph showing the relationship between the frequency of an oscillation voltage as a superimposed voltage applied to the conductive fur brush roller provided in the apparatus of FIG. 3 and toner recovery.

FIG. 7 shows the relationship between the changes in the oscillation voltage and the toner recovery when a superimposed voltage of a sinusoidal waveform is applied to the fur brush roller. FIG. 8 shows the relationship between the changes in the oscillation voltage as the superimposed voltage applied to the fur brush roller and the toner recovery.

As shown in FIG. 7, when the DC voltage as the superimposed voltage applied to the conductive fur brush roller 115 and the frequency of the oscillation voltage are fixed to −700 V and 880 Hz, respectively, an increase in the oscillation voltage results in an increase in the toner recovery of the fur brush roller 115. Further, as shown in FIG. 8, when the DC voltage as the superimposed voltage applied to the conductive fur brush roller 115 and the frequency of the oscillation voltage are fixed to −700 V and 880 Hz, respectively, an increase in the frequency of the oscillation voltage results in an increase in the toner recovery of the fur brush roller 115.

In this embodiment, the above properties are utilized. As in the above-described second embodiment, one of the oscillation voltage as the superimposed voltage applied to the conductive fur brush roller 115 and the frequency of the oscillation voltage or both of them are set to an appropriate value, whereby the relative proportion of the recovery toner and the toner to be re-utilized can be adjusted. Thus, as in the above embodiment, in diminishing the size of the cleaner container 121, it is possible to design it such that it has an optimum capacity.

Fourth Embodiment

Figure 9:
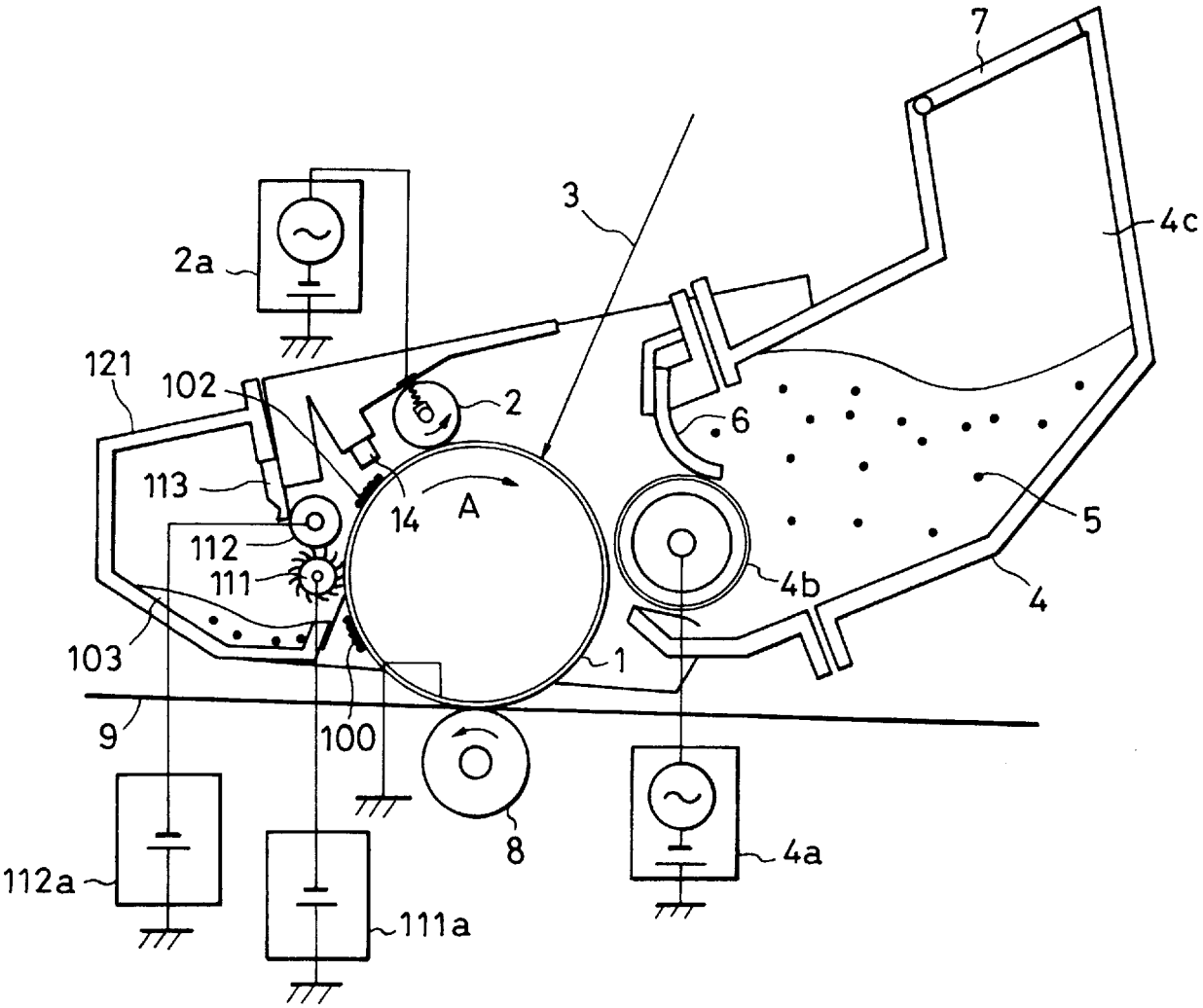
FIG. 9 is a sectional view showing a process cartridge according to a further embodiment of the present invention.
Figure 10:
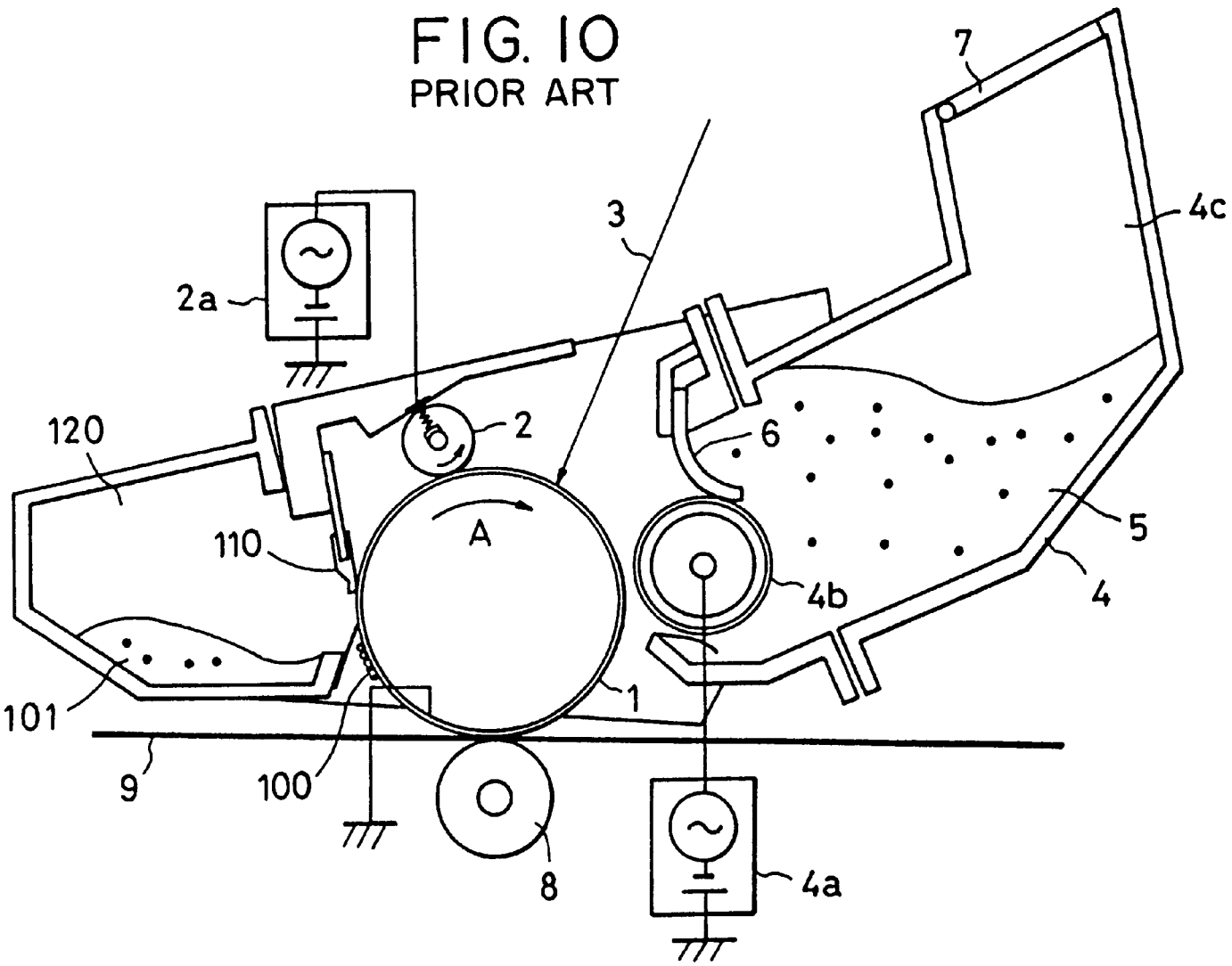
FIG. 10 PRIOR ART
FIG. 10 is a sectional view showing a process cartridge of a conventional image forming apparatus.

FIG. 9 is a sectional view of a further embodiment of the present invention. In this embodiment, a pre-exposure light source 14 is provided on the upstream side of the charging roller 2 in order to improve the recovery efficiency in recovering the toner 102 to be re-utilized from the photosensitive drum 1 by the developing device 4 in the embodiment of FIG. 1.

By removing the charge from the surface of the photosensitive drum 1 negatively charged by the conductive fur brush roller 111 by a uniform beam from the pre-exposure light source 14, it is possible to sufficiently remove the electrostatic adsorptive force of the toner 102 to be reutilized on the photosensitive drum 1, so that an improvement is achieved in terms of the efficiency in the recovery of toner 102 by the developing device 4.

In accordance with this embodiment, the amount of toner to be re-utilized increases, and this toner can be reliably recovered by the developing device 4, whereby it is possible to stably continue to obtain high-quality images.

In the above embodiments the photosensitive member 1, the charger 2, and the developing device 4 are integrally formed as a process cartridge. In particular, in the fourth embodiment, the light source 14 is incorporated in the process cartridge. In another modification, the developing device may be excluded. Further, the cleaning device may be formed by integrally combining the charger 2 and the developing device 4, with the photosensitive body being excluded.

Further, the charger is not restricted to a roller electrode. It may also be a conventional corona charger. Regarding the developing device, while those in the above embodiments are of the type in which toner is supplied thereto, this should not be construed restrictively. The developing device may be of the type whose service life is terminated when the toner sealed therein has been consumed.

The present invention, described above, is effective in an apparatus which is continued to be used with the cleaning device being installed in the apparatus body for a long period of time, as in a case in which 5000 to 20000 pages are to be output. Thus, in the case of a cartridge of the type which integrally incorporates a cleaning device whose service life is terminated when the toner sealed therein has been consumed, the effective toner capacity of the developing device is such that it allows printing of 10000 pages or more.

Further, since the present invention is effective in a construction in which the cleaning side cartridge is used for a long period of time, the present invention also proves effective in the case of a construction in which only the developing device is replaced whenever the toner sealed therein has been consumed.

What is claimed is:

1. An image forming apparatus comprising:

an image carrier;

developing means for forming a toner image by developing an electrostatic image formed on said image carrier with toner, said developing means simultaneously performing a developing operation and recovering normally-charged toner from said image carrier;

image transfer means for transfering the toner image from said image carrier to a transfer material; and a cleaning device for cleaning the toner remaining on said image carrier after an image transfer operation by said image transfer means, said cleaning device having a container for containing the toner removed from said image carrier and a rotating cleaning member for cleaning reversed-charged toner on said image carrier and through which the normally-charged toner passes while scattering the normally-charged toner on said image carrier, wherein a voltage which has a component of a same polarity as a charging polarity of the normally-charged toner, is applied to said rotating cleaning member, and said rotating cleaning member is disposed so as to contact said image carrier rotating with a circumferential speed, which is different from a circumferential speed of said image carrier, wherein the electrostatic image is formed on said image carrier while the normally-charged toner, scattered by said rotating cleaning member, is carried on said image carrier, and the normally-charged toner is capable of being recovered by said developing means, and wherein the scattered normally-charged toner has an average grain size and a distribution density that is sufficiently small to produce a desired amount of scattering such that there is no deterioration in a quality of the toner image.

2. An image forming apparatus according to claim 1, wherein the voltage is an oscillating voltage.

3. An image forming apparatus according to claim 1, wherein said rotating cleaning member comprises a brush.

4. An image forming apparatus according to claim 1, wherein said cleaning device comprises a second rotating member, which electrostatically attracts toner from said rotating cleaning member.

5. An image forming apparatus according to claim 4, wherein said cleaning device comprises a scraping means for scraping toner from said second rotating member.

6. An image forming apparatus according to claim 1, further comprising a electrostatic image forming means for forming the electrostatic image, said electrostatic image forming means including charging means for charging said image carrier, wherein a charging polarity of said charging means is a same polarity as that of the normally-charged toner.

7. An image forming apparatus according to claim 6, wherein said charging means is disposed so as to contact said image carrier.

8. An image forming apparatus according to claim 1, wherein a resistance of said rotating cleaning member is $10^3$–$10^{10}\Omega$ when a DC voltage of 50 V is applied thereto.

9. An image forming apparatus according to claim 1, wherein a rotating direction of said rotating cleaning member is a same direction as a rotating direction of said image carrier at a contact portion of said cleaning rotating member and said image carrier.

10. An image forming apparatus according to claim 1, wherein a rotating direction of said rotating cleaning member is a direction opposite to a rotating direction of said image carrier at a contact portion of said cleaning rotating member and said image carrier.

11. An image forming apparatus according to claim 1, wherein said cleaning device and said image carrier are disposed in a process cartridge detachably mountable to an assembly of said image forming apparatus.

12. An image forming apparatus according to claim 1, wherein the average grain size of the scattered normally-charged toner is 10 micrometers or less.

13. An image forming apparatus according to claim 1, wherein the distribution density of the scattered normally-charged toner is 0.1 $g/cm^2$ or less.

14. An image forming apparatus comprising:

an image carrier;

developing means for forming a toner image by developing an electrostatic image formed on said image carrier with toner, said developing means simultaneously performing a developing operation and recovering normally-charged toner from said image carrier;

image transfer means for transferring the toner image from said image carrier to a transfer material; and a cleaning device for cleaning the toner remaining on said image carrier after an image transfer operation by said image transfer means, said cleaning device including a container for containing the toner removed from said image carrier and a rotating cleaning member for cleaning reversed-charged toner on said image carrier and through which the normally-charged toner passes while scattering the normally-charged toner on said image carrier, wherein said rotating cleaning member is disposed so as to contact said image carrier, and a superimposed voltage, which includes an oscillating voltage and a voltage of a same polarity as the charging polarity of normally-charged toner, is applied to said rotating cleaning member, and wherein the electrostatic image is formed on said image carrier while the normally-charged toner, scattered by said rotating cleaning member, is carried on said image carrier, and the normally-charged toner is capable of being recovered by said developing means.

15. An image forming apparatus according to claim 14, wherein said rotating cleaning member comprises a brush.

16. An image forming according to claim 14, wherein said cleaning device comprises a second rotating member, which electrostatically attracts toner from said rotating cleaning member.

17. An image forming apparatus according to claim 16, wherein said cleaning device comprises a scraping means for scraping toner from said second rotating member.

18. An image forming apparatus according to claim 14, further comprising an electrostatic image forming means forming the electrostatic image, said electrostatic image forming means including charging means for charging said image carrier, wherein a charging polarity of said charging means is a same polarity as that of the normally-charged toner.

19. An image forming apparatus according to claim 18, wherein said charging means is disposed so as to contact said image carrier.

20. An image forming apparatus according to claim 14, wherein a resistance of said rotating cleaning member is $10^3$–$10^{10}$ Ω when a DC voltage of 50 V is applied thereto.

21. An image forming apparatus according to claim 14, wherein a rotating direction of said rotating cleaning member is a same direction as a rotating direction of said image carrier at a contact portion of said cleaning rotating member and said image carrier.

22. An image forming apparatus according to claim 14, wherein a rotating direction of said rotating cleaning member is in a direction opposite to a rotating direction of said image carrier at a contact portion of said cleaning rotating member and said image carrier.

23. An image forming apparatus according to claim 14, wherein said cleaning device and said image carrier are disposed in a process cartridge detachably mountable to an assembly of said image forming apparatus.

24. An image forming apparatus according to claim 14, wherein the scattered normally-charged toner has an average grain size and a distribution density that is sufficiently small to produce a desired amount of scattering such that there is no deterioration in a quality of the toner image.

25. An image forming apparatus according to claim 15, wherein said rotating cleaning member comprises a brush.

* * * * *

UNITED STATES PATENT AND TRADEMARK OFFICE

CERTIFICATE OF CORRECTION

PATENT NO. : 6,400,918 B1
DATED : June 4, 2002
INVENTOR(S) : Yasuyuki Ishii et al.

It is certified that error appears in the above-identified patent and that said Letters Patent is hereby corrected as shown below:

Title page,
Item [57], ABSTRACT,
Line 11, "bush" should read -- brush --.

Column 2,
Line 7, "section 9" should read -- section --.

Column 4,
Line 49, "roller 11" should read -- roller 111 --.

Column 8,
Line 53, "a" should read -- an --.

Column 9,
Line 17, "0.1 g/cm$^2$" should read -- 0.1 mg/cm$^2$ --.

Column 10,
Line 3, "forming" should read -- forming apparatus --.

Signed and Sealed this

Second Day of December, 2003

JAMES E. ROGAN
*Director of the United States Patent and Trademark Office*